US007306318B2

(12) United States Patent
Oku

(10) Patent No.: US 7,306,318 B2
(45) Date of Patent: Dec. 11, 2007

(54) INKJET PRINTING DEVICE

(75) Inventor: Nobuaki Oku, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 265 days.

(21) Appl. No.: 11/033,120

(22) Filed: Jan. 12, 2005

(65) Prior Publication Data

US 2005/0151781 A1 Jul. 14, 2005

(30) Foreign Application Priority Data

Jan. 14, 2004 (JP) ..... 2004-007395
Jan. 14, 2004 (JP) ..... 2004-007396

(51) Int. Cl.
*B41J 2/165* (2006.01)

(52) U.S. Cl. ..... 347/33; 347/29; 347/32

(58) Field of Classification Search ..... 347/22–24, 347/29, 30, 32, 33
See application file for complete search history.

(56) References Cited

U.S. PATENT DOCUMENTS 4,450,456 A * 5/1984 Jekel et al. ..... 347/29
6,886,907 B1 * 5/2005 Okamoto et al. ..... 347/33

FOREIGN PATENT DOCUMENTS

JP A 06-143597 5/1994
JP A 09-048134 2/1997

* cited by examiner

*Primary Examiner*—Shih-Wen Hsieh
(74) *Attorney, Agent, or Firm*—Oliff & Berridge, PLC

(57) ABSTRACT

There is provided an inkjet printing device, which is provided with an inkjet head and an ejection restoring system configured to restore ejection performance of the inkjet head. The ejection restoring system includes a wiping member used to wipe residual ink off a nozzle surface of the inkjet head, a wiper driving system that moves the wiping member relative to the nozzle surface, and a wiper maintenance unit that removes ink adhered to the wiping member. The wiper maintenance unit includes a cassette having an absorbent member therein. The absorbent member absorbs ink adhered to the wiping member. The wiper maintenance unit further includes a cassette holder to which the cassette is detachably attached.

23 Claims, 11 Drawing Sheets

INKJET PRINTING DEVICE

INCORPORATION BY REFERENCE

This application claims priority of Japanese Patent Applications No. 2004-007395, filed on Jan. 14, 2004, and No. 2004-007396, filed on Jan. 14, 2004, the entire subject matter of the applications is incorporated herein by reference thereto.

BACKGROUND OF THE INVENTION

The present invention relates to an inkjet printing device. More specifically, the present invention relates to an inkjet printing device having a wiper blade used to wipe ink off a nozzle surface.

Inkjet printing devices configured to have a wiper blade are widely used. The wiper blade removes residual ink adhered to a nozzle surface of an inkjet head, so that deterioration of ejection performance of the nozzle surface is avoided.

Japanese Patent Provisional Publication No. HEI 9-48134 (hereafter, referred to as a document 1) discloses such an inkjet printing device. In the inkjet printing device disclosed in the document 1, a hydrophile absorbent and a wiper blade made of hydrophile material are contained in a holder in such a manner that the hydrophile absorbent closely contacts with a base portion of the wiper blade. The ink removed by the wiper blade from the nozzle surface is absorbed by the wiper blade, and then is absorbed by the hydrophile absorbent through the base portion of the wiper blade.

Japanese Patent Provisional Publication No. HEI 6-143597 (hereafter, referred to as a document 2) also discloses such an inkjet printing device. In the inkjet printing device disclosed in the document 2, an absorbent member is located on the downstream side of a nozzle surface along a moving path of a wiper blade so that ink adhered to the wiper blade is absorbed by the absorbent member.

SUMMARY OF THE INVENTION

As described above, in the conventional inkjet printing device, the residual ink can be removed by use of the wiper blade. However, the conventional inkjet printing device has a drawback that wiping performance is deteriorated by various types of factors.

One of such factors is that ink is deposited on the wiper blade, viscosity of the ink on the wiper blade gradually increases as the number of times that the wiper blade is used increases, and thereby the wiping performance deteriorates increasingly.

Another factor is that air bubbles are adhered to the wiper blade when the wiper blade is detached from the absorbent member for moving back to its initial position. If the air bubbles are adhered to the wiper blade, the air bubbles are adhered to the nozzle surface at the next time the wiper blade wipes the nozzle surface, and the ejection performance of the nozzle surface is deteriorated.

The present invention is advantageous in that it provides an inkjet printing device configured to avoid deterioration of the wiping performance of a wiper blade.

According to an aspect of the invention, there is provided an inkjet printing device, which is provided with an inkjet head that ejects ink onto a substrate, and an ejection restoring system configured to restore ejection performance of the inkjet head. The ejection restoring system includes a wiping member used to wipe residual ink off a nozzle surface of the inkjet head, a wiper driving system that moves the wiping member relative to the nozzle surface, and a wiper maintenance unit that removes ink adhered to the wiping member.

In this structure, the wiper maintenance unit includes a cassette having an absorbent member therein. The absorbent member absorbs ink adhered to the wiping member. The wiper maintenance unit further includes a cassette holder to which the cassette is detachably attached.

Since the wiper maintenance unit has the cassette holder to which the cassette is detachably attached, the absorbent member can be easily replaced with new one by replacing the cassette. Accordingly, deterioration of wiping performance of the wiping member can be avoided reliably.

Optionally, the wiper maintenance unit may be located at a predetermined position along a moving path of the wiping member to remove ink adhered to the wiping member.

Still optionally, the inkjet printing device may include a sucking device configured to closely contact the nozzle surface to suck the ink from the nozzle surface.

Still optionally, the cassette holder may have an ink catching part that catches ink dropping from at least one of the inkjet head, the wiping member and the sucking device.

Still optionally, the ink catching portion may be elongated under a moving range of the wiping member so as to catch the ink dropping from the wiping member.

Still optionally, the ink catching portion may be elongated to catch the ink dropping from all of the inkjet head, the wiping member and the sucking device.

Still optionally, the wiper maintenance unit may be configured such that the cassette holder is detachably attached to the wiper maintenance unit.

Still optionally, the cassette holder may include an upper housing and a lower housing. The upper housing is attached to the lower housing so as to be openable and closable with respect to the lower housing.

Still optionally, the cassette may be detachably attached to the upper housing of the cassette holder. The cassette is held between the upper housing and the lower housing when the upper housing is in a closed state.

Still optionally, the upper housing may has a hooking nail, and the cassette may have an engagement hole to which the hooking nail of the upper housing is fixedly hooked.

Still optionally, the wiping member may have an edge portion that contacts the nozzle surface to wipe the residual ink off the nozzle surface. In this case, the absorbent member is located, at an end position of a moving path of the wiping member, on a downstream side of the nozzle surface. The absorbent member contacts the wiping member so as to absorb ink adhered to the wiping member when the wiping member is situated at the end position. The edge portion of the wiping member does not contact the absorbent member when the wiping member is situated at the end position.

According to another aspect of the invention, there is provided an inkjet printing device, which is provided with an inkjet head that ejects ink onto a substrate, and an ejection restoring system configured to restore ejection performance of the inkjet head. The ejection restoring system includes a wiping member having an edge portion that contacts a nozzle surface of the inkjet head to wipe residual ink off the nozzle surface, a wiper driving system that moves the wiping member relative to the nozzle surface, and a wiper maintenance unit that removes ink adhered to the wiping member.

In this structure, the wiper maintenance unit includes a first absorbent member that is located, at an end position of a moving path of the wiping member, on a downstream side of the nozzle surface. The first absorbent member contacts the wiping member so as to absorb ink adhered to the wiping member when the wiping member is situated at the end position. The edge portion of the wiping member does not contact the first absorbent member when the wiping member is situated at the end position.

With this configuration, it becomes possible to prevent the adhesion of the air bubbles to the tip portion of the wiping member when the wiping member detaches from the first absorbent member. Proper ink ejecting operation of the nozzle surface can be maintained. That is, deterioration of wiping performance of the wiping member can be avoided reliably.

Optionally, the wiper maintenance unit may be located at a predetermined position along the moving path of the wiping member to remove ink adhered to the wiping member.

Still optionally, the first absorbent member may have a contacting surface that contacts a base portion of the wiping member when the wiping member is situated at the end position.

Still optionally, the wiper maintenance unit may include a second absorbent member located on the downstream side of the nozzle surface along the moving path of the wiping member. In this case, the second absorbent member contacts the edge portion of the wiping member to absorb ink adhered to the wiping member when the wiping member moves along the moving path.

Still optionally, the wiper maintenance unit may include a third absorbent member located on an opposite side of the second absorbent member with respect to the moving path of the wiping member. In this case, the third absorbent member lies under the second absorbent member so as to absorb ink dropping thereon.

Still optionally, the third absorbent member may be located adjacently to the first absorbent member.

Still optionally, the second absorbent member may be located such that the edge portion of the wiping member does not contact the second absorbent member when the wiping member is situated at the end position.

Still optionally, the wiper maintenance unit may include a cassette in which the first, second and third absorbent members are accommodated, and a cassette holder to which the cassette is detachably attached.

According to an aspect of the invention, there is provided a wiper maintenance unit for removing ink adhered to a wiping member. The wiper maintenance unit is provided with a cassette having an absorbent member therein. The absorbent member absorbs ink adhered to the wiping member when the wiping member contacts the absorbent member. The wiper maintenance unit is provided with a cassette holder to which the cassette is detachably attached.

Since the wiper maintenance unit has the cassette holder to which the cassette is detachably attached, the absorbent member can be easily replaced with new one by replacing the cassette. Accordingly, deterioration of wiping performance of the wiping member can be avoided reliably.

According to an aspect of the invention, there is provided a wiper maintenance unit for removing ink adhered to a wiping member. The wiper maintenance unit is provided with a cassette, and a first absorbent member fixed to an inner surface of the cassette. The first absorbent member is located, at an end position of a moving path of the wiping member, on a downstream side of a nozzle surface to contact the wiping member situated at the end position. The first absorbent member absorbs ink adhered to the wiping member when the wiping member is situated at the end position. The first absorbent member is configured such that an edge portion of the wiping member does not contact the first absorbent member when the wiping member is situated at the end position.

With this configuration, it becomes possible to prevent the adhesion of the air bubbles to the tip portion of the wiping member when the wiping member detaches from the first absorbent member. Proper ink ejecting operation of the nozzle surface can be maintained. That is, deterioration of wiping performance of the wiping member can be avoided reliably.

BRIEF DESCRIPTION OF THE ACCOMPANYING DRAWINGS

DETAILED DESCRIPTION OF THE EMBODIMENTS

Hereafter, an embodiment according to the invention will be described with reference to the accompanying drawings.

Figure 1:
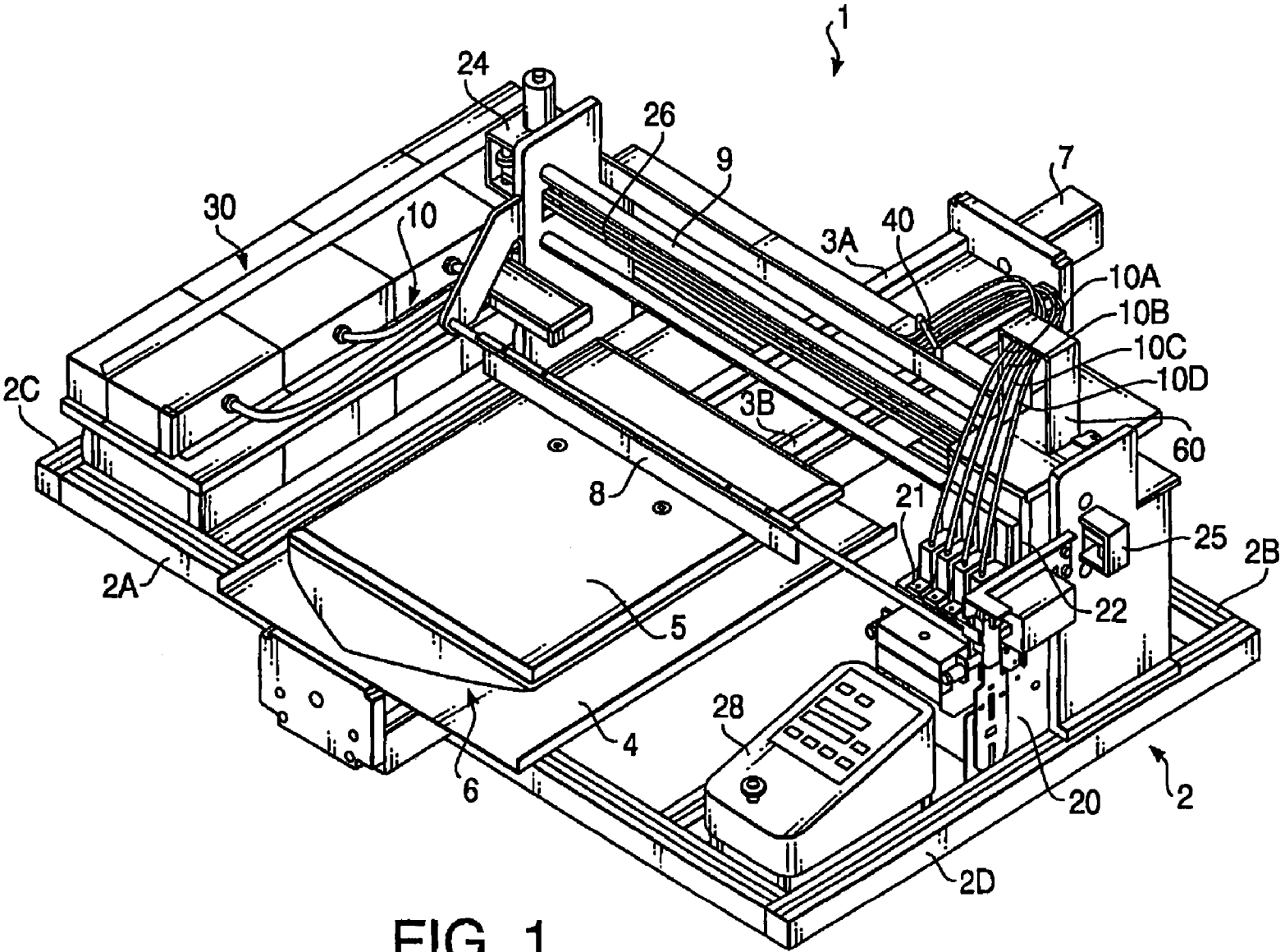
FIG. 1 is a perspective view of an inkjet printing device according to an embodiment of the invention illustrating the entire configuration of the inkjet printing device.

FIG. 1 is a perspective view of an inkjet printing device 1 according to an embodiment of the invention illustrating the entire configuration of the inkjet printing device 1. The inkjet printing device 1 is configured to form images or designs on a substrate such as fabric (T-shirt and etc.).

As shown in FIG. 1, the inkjet printing device 1 includes a frame 2 having a rectangular form. The frame 2 includes a front frame 2A, a rear frame 2B, a left frame 2C and a right frame 2D, each of which has a form of a rectangular column and is made of aluminum. In the following explanation, a direction parallel with the left and right frames 2C and 2D is called a back-and-forth direction, and a direction parallel with the front and rear frames 2A and 2B is called a lateral direction.

The inkjet printing device 1 includes a platen 5 and a platen driving mechanism 6. The platen driving mechanism 6 is configured to move the platen 5 in the back-and-forth direction of the frame 2. More specifically, the platen driving mechanism 6 includes two rails 3A and 3B mounted on the frame 2 such at the front portions the rails 3A and 3B lie in the center of the front frame 2A and the rear portions of the rails 3A and 3B lie in the center of the rear frame 2B. The rails 3A and 3B are located to be parallel with the back-and-forth direction.

The rails 3A and 3B are supported by base units (not shown) which are formed to protrude in a vertical direction from a bottom surface of the frame 2. A plate-like platen support base (not shown) is mounted on the rails 3A and 3B to be movable along the rails 3A and 3B. The platen 5 is detachably attached to the top of a column which is formed at the central portion on a top surface of the platen support base to protrude in a vertical direction.

The platen 5 is a plate-like member having a rectangular form whose longer sides are parallel with the back-and-forth direction. A substrate (e.g. T-shirt) is loaded on the platen 5 so that a print target surface of the substrate is horizontally placed on the top surface of the platen 5 and is kept in a state of tension. Antislip material is applied to the top surface of the platen 5 so as to prevent the print target surface of the substrate from being shifted from its initial position during a printing operation.

Figure 4:
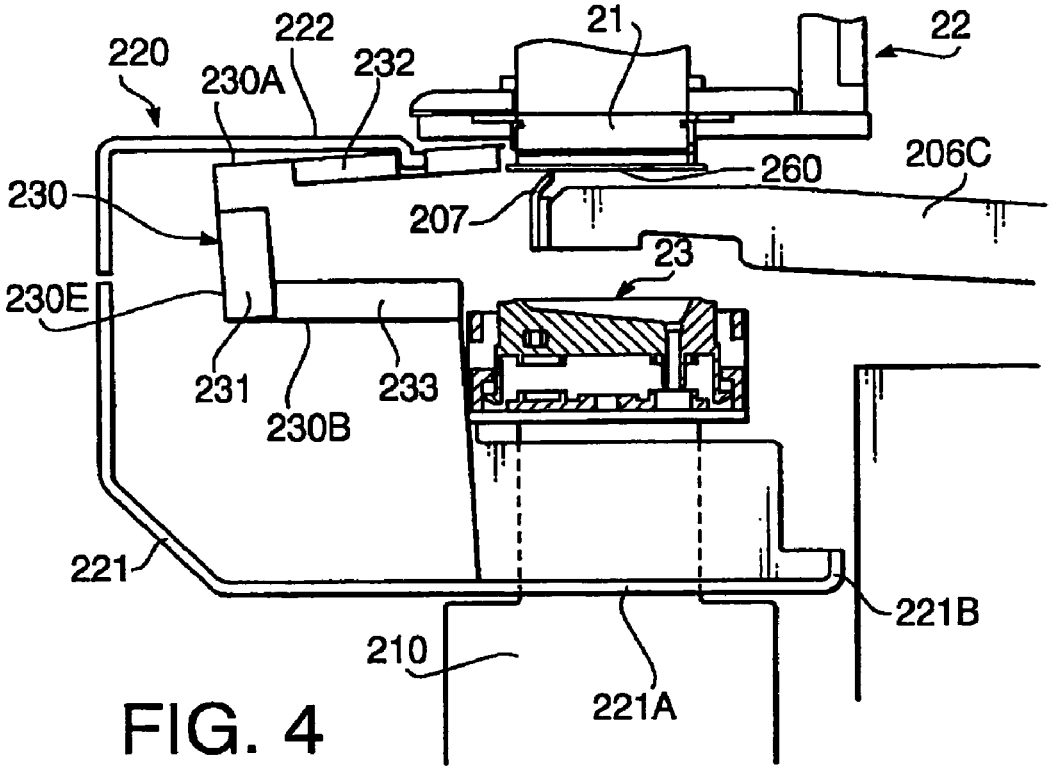
FIG. 4 is an enlarged view of the cross section shown in FIG. 3 illustrating in detail a configuration in the vicinity of a cassette holder.

A tray 4 is fixed to the column at the central portion between the platen 5 and the platen support base. As shown in FIG. 4, the tray 4 has a bottom surface which is parallel with the platen 5 and has a size larger than the platen 5. In a situation in which a T-shirt is loaded on the platen 5, sleeves of the T-shirt are laid on the tray 4, and thereby it becomes possible to prevent the sleeves from falling to the bottom surface of the frame 2.

On the rear side of the platen driving mechanism 6, a platen motor 7 is provided to move the platen 5 in the back-and-forth direction. A driving belt is hung to a driving shaft of the platen motor 7 and a pulley provided at the front end of the rails 3A and 3B. The platen support base is fixed to the driving belt. With this structure, the platen support base (platen 5) is moved along the rails 3A and 3B by driving force of the platen motor 7. That is, the platen 5 reciprocates along the rails 3A and 3B in the back-and-forth direction by driving force of the platen motor 7. In this embodiment, a front end position on the rails 3A and 3B is defined as a standby position (default position) of the platen 5.

At the front portion of the rails 3A and 3B, a photosensor is provided to detect that the platen 5 has been moved to an endpoint in a moving direction when the platen 5 is moved from the rear side to the front side in the moving direction for the printing operation.

At the rear side of the rails 3A and 3B, two photosensors are provided. One of the two photosensors is provided to detect that the platen 5 is located at a starting point in the moving direction for the printing operation. The other photosensor is provided to detect that the platen 5 is located at a starting point for a reading operation.

Each of the above mentioned photosnesors is configured to have a light source and a photoreceptor which receives light emitted by the light source. The platen 5 is provided with a blocking member on the bottom surface thereof. By this structure, the position of the platen 5 is detected by each photosnesor when the blocking member of the platen 5 passes through an interval of the light source and the photoreceptor of each photosensor.

Since the platen motor 7 is a stepping motor, the position of the platen 5 can be determined by controlling driving pulses for the platen motor 7. Specifically, the position of the platen 5 is determined by controlling the platen motor 7 with respect to the starting points and the endpoint detected by the photosensors.

When the printing operation is started, the platen 5 located at the standby position (i.e. at the front end of the rails 3A and 3B) is carried to the rear end of the rails 3A and 3B. Then, the platen 5 is moved from the rear end of the rails 3A and 3B (i.e. the starting point of the printing operation).

Above the platen 5 driving mechanism 6, a guide rail 9 is provided on the rear side of the frame 2 to movably support a carriage 22 in which four piezoelectric type inkjet heads 21 are mounted. The guide rail 9 is mounted to be parallel with the rear frame 2B. The inkjet heads 21 are also aligned in parallel with the rear frame 2B.

A carriage belt 26 is hung to a driving shaft of a carriage motor 24 provided at the left end portion of the guide rail 9 and to a pulley 25 provided at the right end portion of the guide rail 9. That is, the carriage belt 26 is installed in the inkjet printing device 1 in parallel with the lateral direction. The carriage 22 is fixed to the carriage belt 26 on the rear surface of the carriage 22. Further, the carriage 22 is provided with a sliding unit (not shown) slidably attached to the guide rail 9. By this structure, the carriage 22 is moved along the guide rail 9 (i.e. the sliding portion slides along the guide rail 9) in the lateral direction by driving the carriage motor 24.

The carriage motor 24 is, for example, a DC motor. The position of the carriage 22 is determined based on an output of a linear encoder provided on the guide rail 9.

The four inkjet heads 21 are located on the bottom surface of the carriage 22. The four inkjet heads 21 respectively correspond to color components of cyan, magenta, yellow and black. Each of the inkjet heads 21 is provided with a plurality of channels (not shown), e.g. 128 channels, for ejecting ink.

More specifically, in each inkjet head 21, a piezoelectric actuator (not shown) is provided for each of the channels, and fine ejection nozzles respectively corresponding to the channels are formed on the bottom surface of each inkjet head. By this structure, the ink is ejected downwardly from each ejection nozzle.

At the left side of the inkjet head printing device 1, a cartridge holding unit 30 configured such that ink cartridges can be detachably attached thereto is located. The ink cartridges contain four types of ink respectively corresponding to color components (CMYK scheme color components) of cyan, magenta, yellow and black.

Each ink cartridge is provided with a supply port to which a supplying tube 10 is attached. The supplying tube 10 is made of elastic material such as polyethylene so that the supplying tube 10 smoothly bends and twists in accordance with movement of the carriage 22. More specifically, four supplying tubes 10A, 10B, 10C and 10C are connect the ink cartridges to the respective inkjet heads 21 through a guide 40 and a tube support 60.

Above the platen 5, the guide 40 is placed in the center of the lateral direction of the frame 2 to support the four supplying tubes 10A, 10B, 10C and 10D at the rear side of the carriage 22. The tube support 60 is provided at the top end of the carriage 22 to support the four supplying tubes 10A, 10B, 10C and 10D. The four supplying tubes 10A, 10B, 10C and 10D are connected through the tube support 60 to the inkjet heads 21 which are located, below the tube support 60, on the front side of the support 60. By this structure, the ink is supplied from the ink cartridges to the respective inkjet heads 21.

At the right end of the guide rail 9, a purge unit 20 which includes suction caps 23 (see FIG. 2) is provided. The purge unit 20 is located such that the suction caps 23 closely contact the inkjet heads 21, respectively, when the carriage 22 is moved to the right end position. The purge unit 20 is provided with a pump (not shown) used to remove the ink from the inkjet heads 21 when the suction caps 23 closely contact the inkjet heads 21.

The suction caps 23 also have the function of preventing drying of the inkjet heads 21 since the suction caps 23 closely contact the inkjet heads 21 while the printing operation is not performed.

On the front right side of the frame 2, an operation panel 28 used for controlling the inkjet printing device 1 is provided. As described later, the operation panel 28 is connected to a controller provided in the inkjet printing device 1 to control the inkjet printing device 1.

Figure 2:
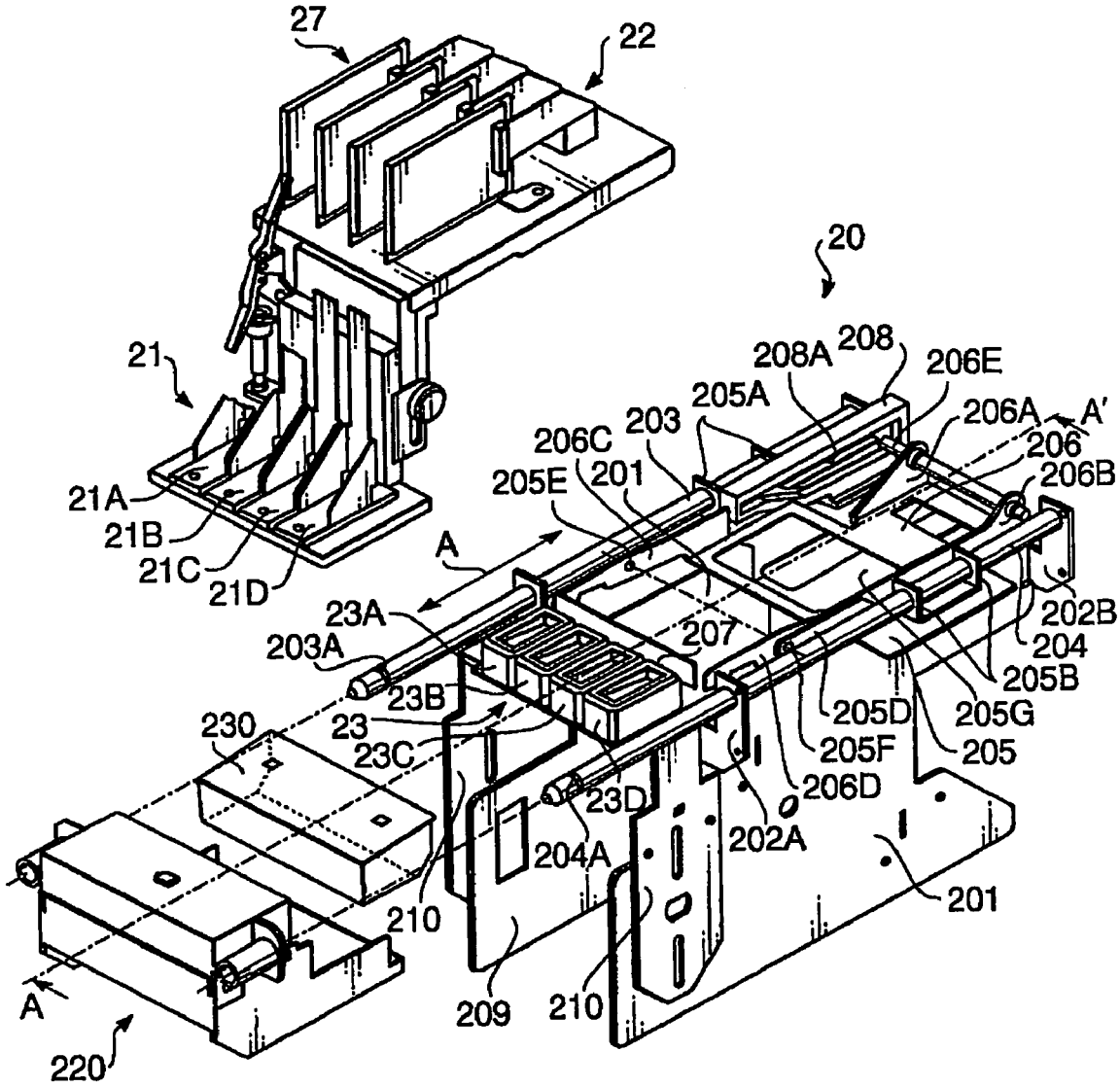
FIG. 2 is a perspective view of a purge unit in the inkjet printing device.
Figure 3:
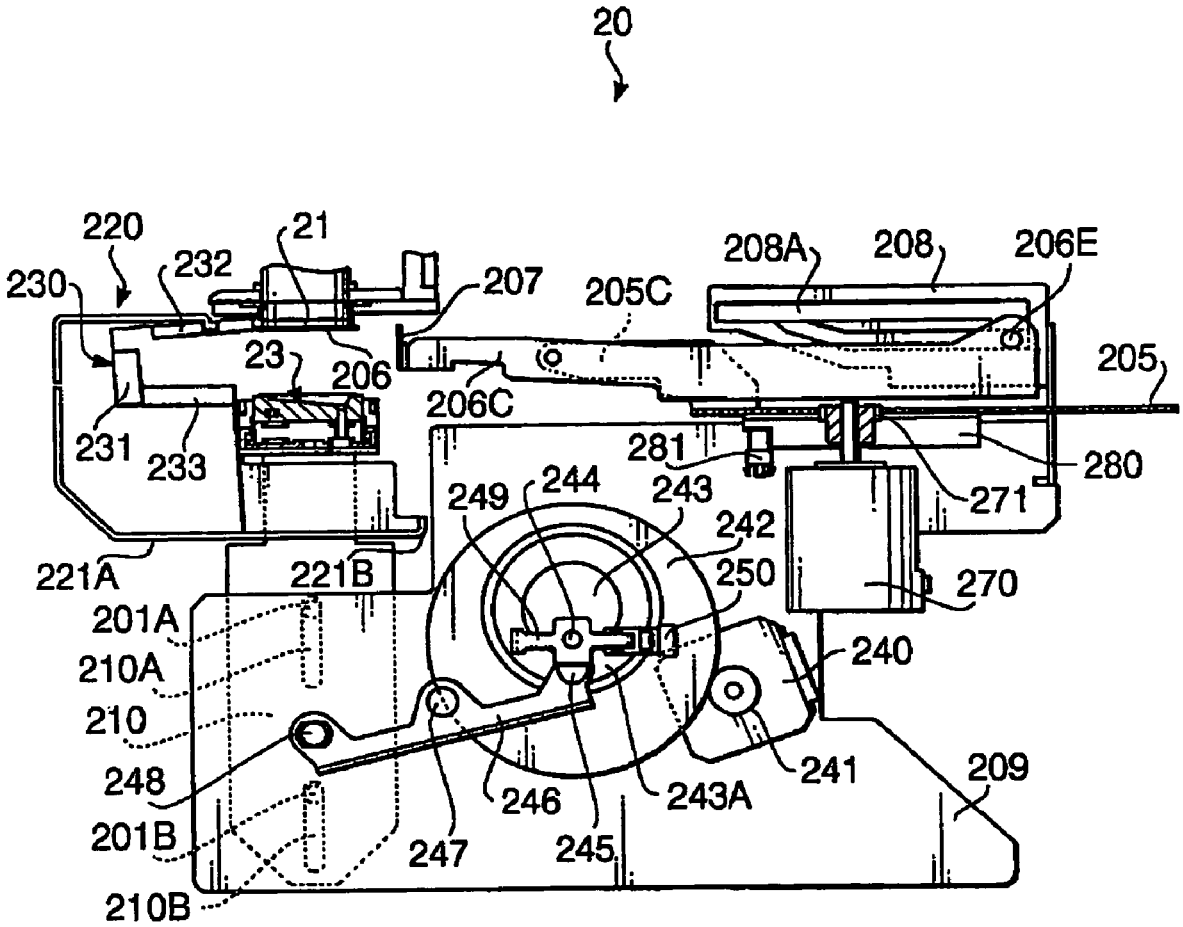
FIG. 3 is a cross-sectional view of the purge unit along a line A-A in FIG. 2.
Figure 5:
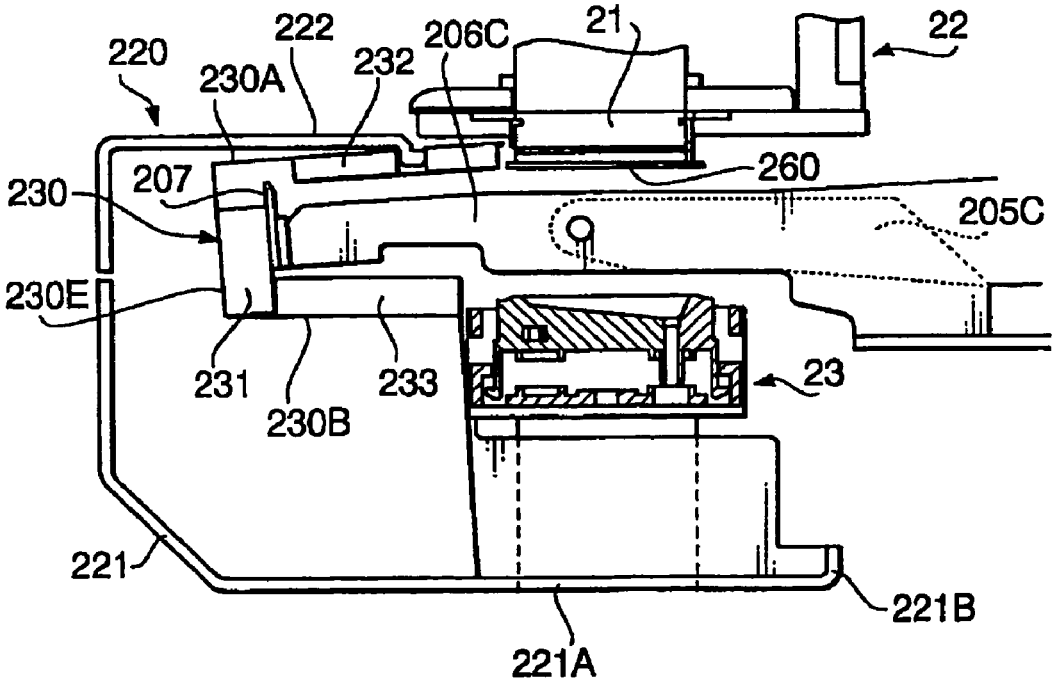
FIG. 5 is an enlarged view of the cross section shown in FIG. 3 illustrating in detail the configuration in the vicinity of the cassette holder.

Next, a configuration of the purge unit 20 functioning as an ejection restoring system that restores the inkjet heads 21 to a normal operation will be described in detail. FIG. 2 is a perspective view of the purge unit 20. FIG. 3 is a cross-sectional view of the purge unit along a line A-A in FIG. 2. FIGS. 4 and 5 are enlarged view of the cross section shown in FIG. 3 illustrating in detail a configuration in the vicinity of a cassette holder 220.

As shown in FIGS. 2 through 5, the purge unit 20 is provided with a body frame having a purge unit frame 209, a purge unit frame 201, a guide shaft support plate 202A located on the front upper side of the frame 209 (201), and a guide shaft support plate 202B located on the rear upper side of the frame 209 (201). A pair of guide shafts 203 and 204 are fixed to the guide shaft support plates 202A and 202B so as to be elongated across the length between the guide shaft support plates 202A and 202B.

Between the guide shaft support plates 202A and 202B, the guide shafts 203 and 204 penetrate sliding members 205A and 205B, respectively. The sliding member 205A (205B) is formed by a metal plate and is fixed by unshown screws to a base plate 205 having a rectangular shape (when it is viewed as a top view). By this structure, the base plate 205 is moveably supported along the guide shafts 203 and 204.

In the center of the base plate 205, a rectangular opening is formed such that longer sides of the rectangular opening are parallel with the guide shafts 203 and 204. Along one of the longer side of the rectangular opening, a rack gear 205G is formed.

The base plate 205 has a pair of support arms 205C and 205D elongated from the front end thereof. On the upper side of the base plate 205, a wiper blade support base 206 is attached. The wiper blade support base 206 has a pair of wiper blade arms 206C and 206D elongated on the front side of the wiper blade support base 206. A wiper blade 207 is held between the front ends of the wiper blade arms 206C and 206D.

More specifically, a holder plate 207C is attached to the front ends (the lower left side of FIG. 2) of the wiper blade arms 206C and 206D, and a base portion 207B of the wiper blade 207 is attached to the holder plate 207C (see FIG. 9), so that a tip portion 207A of the wiper blade 207 is formed as a free end. The wiper blade arms 206C and 206D are rotatably attached to the front ends of the support arms 205C and 205D by shaft portions 205E and 205F located at the center positions of the wiper blade arms 206C and 206D, respectively.

At the rear end (the upper right side of FIG. 2) of the wiper blade support base 206, cam follower shaft support plates 206A and 206B are formed on the wiper blade support base 206 to protrude upwardly in the vertical direction and to be parallel with the guide shafts 203 and 204. The cam follower shaft support plates 206A and 206B rotatably support a cam follower shaft 206E.

In the vicinity of the guide shaft 203, a cam plate 208 having a cam groove 208A is fixed to the body frame, on the rear side of the purge unit 20, to be parallel with the guide shaft 203. The cam follower shaft 206E is supported by the cam follower shaft support plates 206A and 206B such that one end of the cam follower shaft 206E is hooked to the cam groove 208A of the cam plate 208.

Under the base plate 205, a wiper driving motor 270 having a driving shaft to which a pinion gear 271 is fixed is provided to move the wiper blade 207. The wiper driving motor 270 is located so that the pinion gear 271 engages with the rack gear 205G formed on the base plate 205. With this structure, the base plate 205 moves in the back-and-forth direction by driving force of the wiper driving motor 270. That is, the wiper blade 207 reciprocates in the back-and-forth direction by the wiper driving motor 270.

The wiper blade support base 206 moves toward the front side of the purge unit 20 as the base plate 205 moves toward the front side of the purge unit 20 since the wiper blade support base 206 is rotatably attached to the support arms 205C and 205D by the shaft portions 205E and 205F at the center positions of the wiper blade arms 206C and 206D. When the wiper blade support base 206 moves toward the front side of the purge unit 20, one end of the cam follower shaft 206E moves along a lower part of the guide groove 208A.

By this structure, the tip portions of the wiper blade arms 206C and 206D are kept at lifted positions (i.e., upwardly rotated positions about the shaft portions 205E and 205F) when the base plate 205 moves toward the front end of the purge unit 20. As shown in FIGS. 3 and 4, when the base plate 205 moves toward the front end of the purge unit 20, the wiper blade 207 also moves toward a cleaning cassette 230, with the wiper blade 207 being kept at the lifted position.

Therefore, as the base plate 205 moves toward the front end of the purge unit 20, the tip portion 207A of the wiper blade 207 slides over a nozzle surface 260 of the inkjet head 21 to wipe the ink off the nozzle surface 206. Further, the wiper blade 207 moves toward the cleaning cassette 230 until the wiper blade 207 comes into contact with a first absorbent member 231 attached to an inner surface of the cleaning cassette 230. While the wiper blade 207 contacts the first absorbent member 231, the ink adhered to the wiper blade 207 is absorbed by the first absorbent member 231.

Next, the inkjet head 21 and the suction cap 23 will be explained in detail. As shown in FIG. 2, the inkjet heads 21A, 21B, 21C and 21D respectively corresponding to the color components of cyan, magenta, yellow and black are provide in the carriage 22. The carriage 22 is further provided with four driving circuit boards 27 configured to drive the inkjet heads 21A, 21B, 21C and 21D, respectively.

Suction caps 23A, 23B, 23C and 23D are located such that when the carriage 22 is moved to a predetermined ejection recovery position, the suction caps 23A, 23B, 23C and 23D respectively face the inkjet heads 21A, 21B, 21C and 21D. As shown in FIG. 2, the suction caps 23A, 23B, 23C and 23D are supported by a suction cap support plate 210 which is provided with two side plate portions respectively formed to be parallel with the purge unit frames 201 and 209. The suction cap support plate 210 is further provided with a horizontal portion on which the suction caps 23A, 23B, 23C and 23D are mounted.

As shown in FIG. 3, long holes 210A and 210B elongated along a moving direction of the suction cap 23 are formed on each side plate portion of the suction cap support plate 210. The purge unit frame 209 is provided with projections 201A and 201B which are caught by the long holes 210A and 210B, respectively. That is, the projections 210A and 210B are slidably supported by the long holes 210A and 210B, respectively.

A suction cap driving motor 240 is fixed to the purge unit frame 209 to move the suction cap 23 in the vertical direction. More specifically, the suction cap driving motor 240 has a gear 241 fixed to a driving shaft thereof. In addition, a large gear 242 is rotatably attached to the purge unit frame 209 such that the large gear 242 is rotatable about a shaft 244 and the large gear 242 engages with the gear 241.

An eccentric cam 243 is fixed to the large gear 242 such that the center of the eccentric can 243 shifts from the center of the large gear 242. Therefore, the eccentric cam 243 rotates about the shaft 244 as the large gear 242 rotates about the shaft 244.

On a side surface of the eccentric can 243, a circular cam groove 243A is formed to catch a cam follower 245 fixed to one end of an arm member 246. The arm member 246 is rotatably attached to the purge unit frame 209 by a shaft 247. The other end of the arm member 246 is hooked to a shaft 248 which is formed on the suction cap guide plate 210 between the long holes 210A and 210B.

By this structure, the cam follower 245 rotates (moves in the vertical direction) about the shaft 247 as the eccentric cam 243 rotates about the shaft 244 by the rotation of the large gear 242, with the cam follower 245 sliding along the circular cam groove 243A. Therefore, by the rotation of the large gear 242, the other end of the arm member 256 also moves in the vertical direction so as to allow the suction cap 23 to move in the vertical direction (i.e. to approach to or move away from the inkjet head 21).

Figure 6:
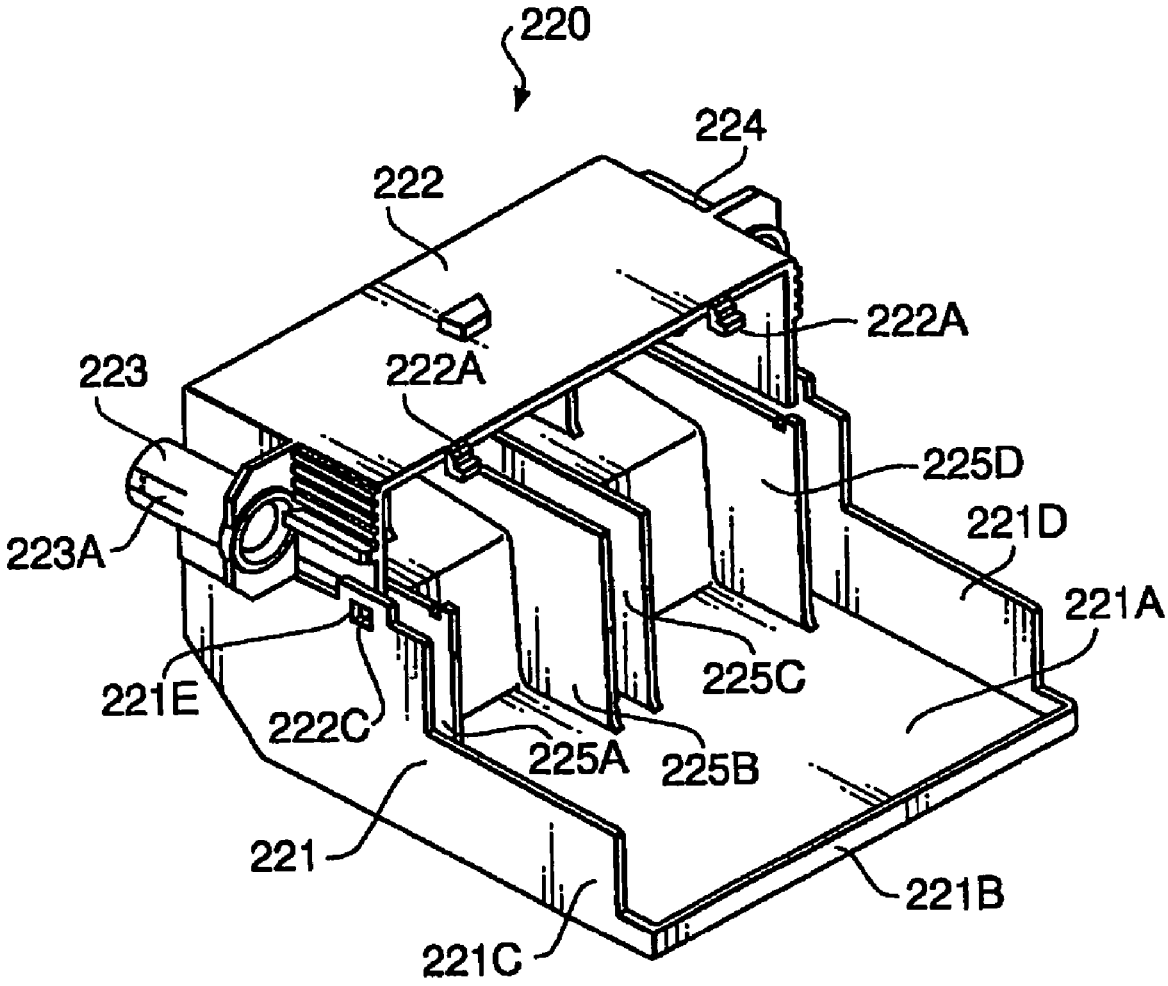
FIG. 6 is a perspective inside view of the cassette holder.
Figure 7:
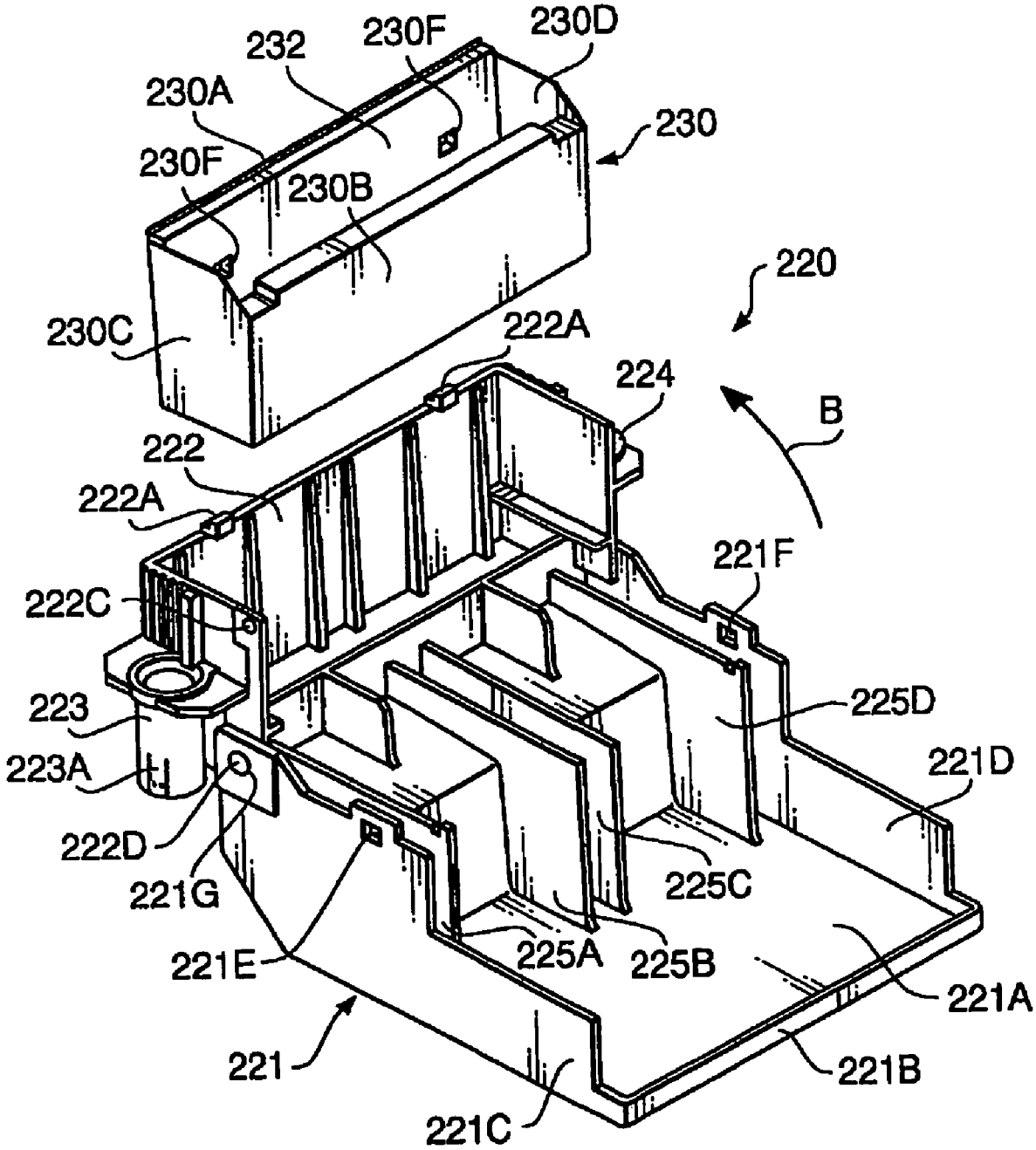
FIG. 7 is a perspective view of the cassette holder in an opened state.
Figure 8:
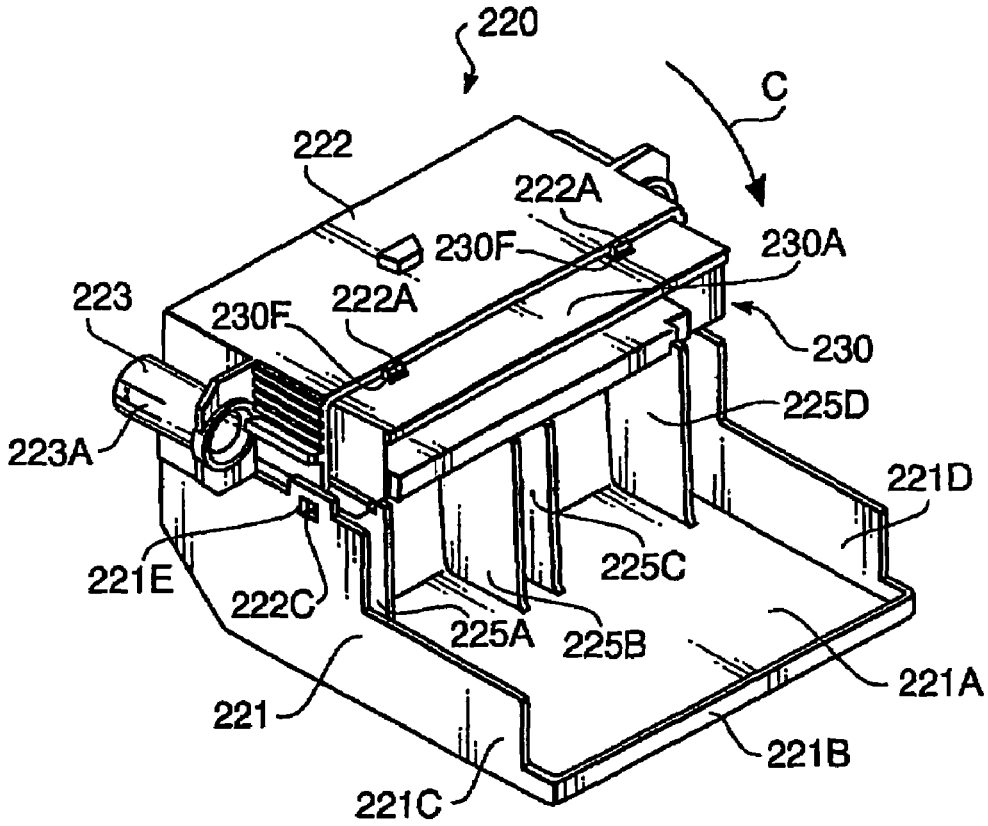
FIG. 8 is a perspective view of the cassette holder illustrating a situation in which the cassette holder accommodates a cleaning cassette.
Figure 9:
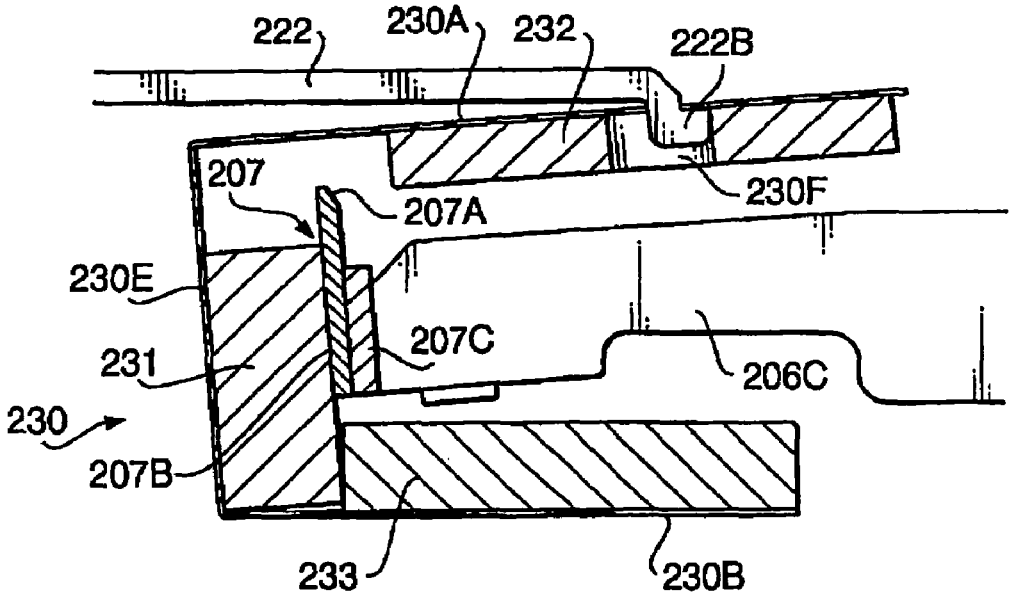
FIG. 9 is a cross-sectional view of the cleaning cassette viewed along a lateral direction.

Next, the cleaning cassette 230 and the cassette holder 220 will be explained in detail with reference to FIGS. 4 to 9. FIG. 6 is a perspective inside view of the cassette holder 220. FIG. 7 is a perspective view of the cassette holder 220 in an opened state. FIG. 8 is a perspective view of the cassette holder 220 illustrating a situation in which the cassette holder 220 accommodates the cleaning cassette 230. FIG. 9 is a cross-sectional view of the cleaning cassette 230 viewed along the lateral direction.

As shown in FIGS. 4, 5, 7 and 8, the cleaning cassette 230 has a form of a box and has one open section. Specifically, the cleaning cassette 230 has an upper wall 230A, a bottom wall 230B, side walls 230C and 230D, and a front wall 230E. The upper wall 230A has an elongated portion like eaves on the upper side of the open section.

As shown in FIGS. 4 and 5, absorbent members 231, 232 and 233 are adhered to the inner surface of the cleaning cassette 230. The first absorbent member 231 is adhered to the inner surface of the front wall 230E, the second absorbent member 232 is adhered to the inner surface of the upper wall 230A, and the third absorbent member 233 is adhered to the inner surface of the bottom wall 230B.

As shown in FIG. 7, engagement holes 230F and 230F are formed in the upper wall 230A of the cleaning cassette 230 to catch hooking nails 222A and 222A formed on an upper housing 222 of the cassette holder 220.

As shown in FIGS. 6 to 8, the cassette holder 220 has the upper housing 222 and a lower housing 221, each of which is made of rein. The upper housing 222 is rotatably attached to the lower housing 222 by shafts 222D provided at bearing portions 221G, so that the upper housing 222 can be rotated about the shafts 222D from a closed state to an opened state by 90 degrees as shown by an arrow B in FIG. 7.

The lower housing 221 has a bottom wall 221A, and side walls 221C and 221D protruding in the vertical direction from the bottom wall 221A at both end portions of the bottom wall 221A. The lower housing 221 further has supporting walls 225A, 225B, 225C and 225D protruding from the bottom wall 221A in parallel with the side walls 221C and 221D so as to support the bottom wall 230B of the cleaning cassette 230.

Engagement holes 221E and 221F are formed in the side walls 221C and 221D, respectively, to catch projections 222C provided on side walls of the upper housing 222. Therefore, when the upper housing 222 is in the closed state, the upper housing 222 is locked.

The upper housing 222 is provided with guide shaft catching portions 223 and 224 into which the guide shafts 203 and 204 are fitted. The guide shaft catching portion 223 has a cylindrical shape and is configured to have a flexible section 223A by forming cut lines in a part of a periphery of the cylindrical shape. The guide shaft catching portion 223 further has an engagement projection on its inner surface so that the engagement projection is fitted into a groove 204A formed on the tip portion of the guide shaft 204. The guide shaft catching portion 224 has the same structure as the guide shaft catching portion 223.

With this structure, the cassette holder 220 can be detachably attached to the guide shafts 203 and 204. A user can detach the cassette holder 220 from the guide shafts 203 and 204 by pulling outward the flexible sections of the catching portions 223 and 224 and thereafter moving the cassette folder 220 toward the front side.

As shown in FIGS. 7 and 8, the upper housing 222 is provided with the hooking nails 222A and 222A at a edge portion thereof, and the engagement holes 230F and 230F are formed in the upper wall 230A to catch hooking nails 222A and 222A, so that the hooking nails 222A and 222A engage with the engagement holes 230F and 230F. As shown in FIG. 8, the cleaning cassette 230 is securely supported in the cassette holder 220 by the supporting walls 225A, 225B, 225C and 225D, and the engagement of the hooking nails 222A and the engagement holes 230F.

To replace the cleaning cassette 230 with a new one, a user firstly removes the cassette holder 220 from the guide shafts 203 and 204 (see FIG. 8), and then rotates upwardly the upper housing 222 as shown in FIG. 7. Next, the user removes the cleaning cassette 230 from the cassette holder 220. After the user fits a new cleaning cassette 230 into the upper housing 222, the user rotates downwardly the upper housing 222 as indicated by an arrow C in FIG. 8 so that the upper housing 222 is fixed to the lower housing 221.

The above mentioned configuration of the cleaning cassette 230 and the cassette holder 220 makes operation of the replacement of the cleaning cassette 230 simple. It is understood that the user can keep the user's hands from being soiled with ink during the replacement operation of the cleaning cassette 230 because the first, second and third absorbent members 231, 232 and 233 which absorb the ink are provided in the cleaning cassette 230.

As described above, the upper housing 222 is provided with the pair of hooking nails 222A and 222A and the cleaning cassette 230 is provided with the pair of engagement holes 230F and 230F. As an alternative to such a configuration, the upper housing 222 may be configured to have a pair of engagement holes, and the cleaning cassette 230 may be configured to have a pair of hooking nails on the upper wall 230A, so that the pair of hooking nails of the cleaning cassette 230 are respectively hooked to the pair of engagement holes of the upper housing 222.

As shown in FIGS. 3 to 5, the bottom wall 221A of the cassette holder 220 is extended under the suction caps 23 and a moving range of the wiper blade 207 so that an edge portion 221B of the bottom wall 221A is situated, under the wiper blade 207, at the rear side of a starting position of the wiper blade 207. With this structure, the bottom wall 221A serves as a tray for catching ink which drops from the wiper blade 207 or the inkjet head 21 so as to keep the purge unit 20 from being soiled.

Next, the first, second and third absorbent members 231, 232 and 233, each of which is made of spongy material for absorbing ink, are explained in detail with reference to FIG. 9. The first absorbent member 231 is adhered to the inner surface of the front wall 230B of the cleaning cassette 230 at a position corresponding to an endpoint of the moving range of the wiper blade 207. The first absorbent member 231 absorbs ink when the wiper blade 207 contacts thereto at the endpoint of the moving range of the wiper blade 207.

A space is formed on the upper side of the first absorbent member 231 so that the tip portion 207A of the wiper blade 207 does not contact the first absorbent member 231 when the base portion 207B of the wiper blade 207 contacts the first absorbent member 231. By this structure, it becomes possible to prevent the adhesion of air bubbles to the tip portion 207A of the wiper blade 207 when the wiper blade 207 is detached from the first absorbent member 231.

Since the adhesion of air bubbles to the tip portion 207A of the wiper blade 207 is prevented, the wiping motion of the wiper blade 207 on the nozzle surface 260 can be performed without causing the adhesion of air bubbles from the wiper blade 207 to the nozzle surface 260. Consequently, proper ink ejecting operation of the nozzle surface 260 can be secured.

As shown in FIG. 4, the second absorbent member 232 is located adjacently to the nozzle surface 260 on the downstream side of the nozzle surface 260 in the moving range of the wiper blade 207. Since the second absorbent member 232 adjoins to the nozzle surface 260, the second absorbent member 232 can absorb drops of ink splashed at the instant at which the wiper blade 207 is detached from the nozzle surface 260, as well as the ink adhered to the wiper blade 207.

At the endpoint at which the wiper blade 207 contacts the first absorbent member 231, the tip portion 207A of the wiper blade 207 does not contact the second absorbent member 232. Therefore, the adhesion of air bubbles from the second absorbent member 232 to the tip portion 207A of the wiper blade 207 can be prevented.

As shown in FIG. 9, at the opposite side of the second absorbent member 232 with respect to a moving path (the moving range) of the wiper blade 207, the third absorbent member 233 is adhered to the inner surface of the bottom wall 230B. The third absorbent member 233 is located adjacently to the first absorbent member 231 to absorb the ink dropped from the wiper blade 207 and to absorb ink from the first absorbent member 231.

Next, a sensing system for sensing positions of the wiper blade 207 (sliding member 205) and the suction cap 23 (suction cap support plate 210) provided in the purge unit 20 will be explained in detail with reference to FIGS. 10 to 14.

Figure 10:
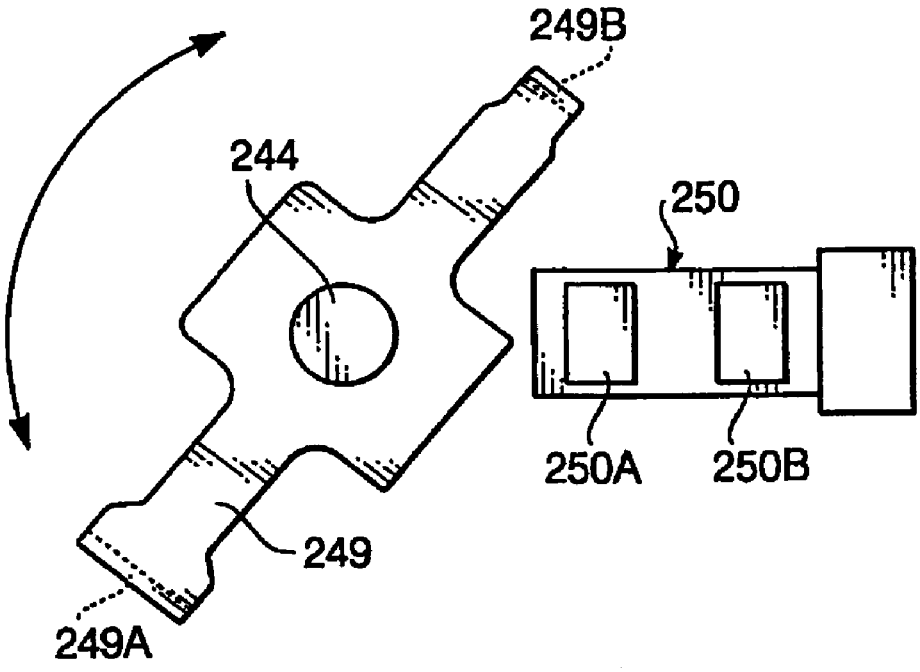
FIG. 10 is a front view of a position sensing arm and a photo interrupter.
Figure 11:
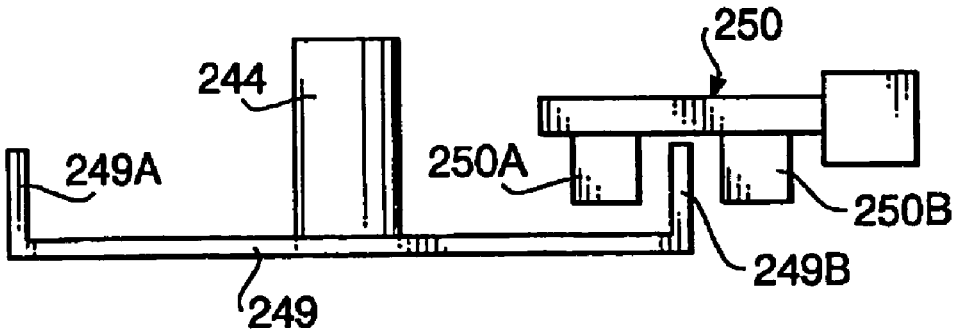
FIG. 11 is a plan view of the position sensing arm and the photo interrupter shown in FIG. 10.
Figure 12:
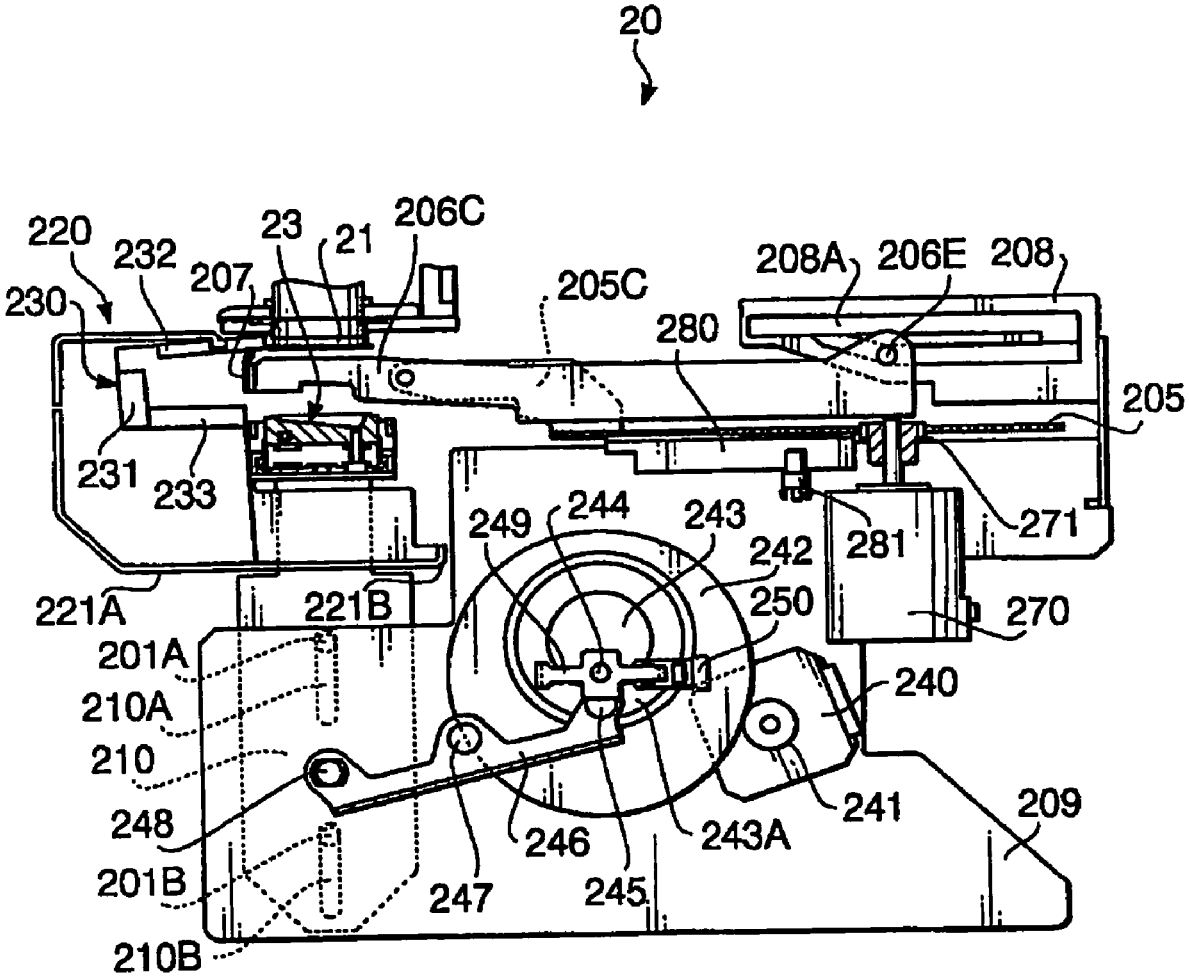
FIG. 12 is a cross-sectional view of the purge unit viewed along the lateral direction.
Figure 13:
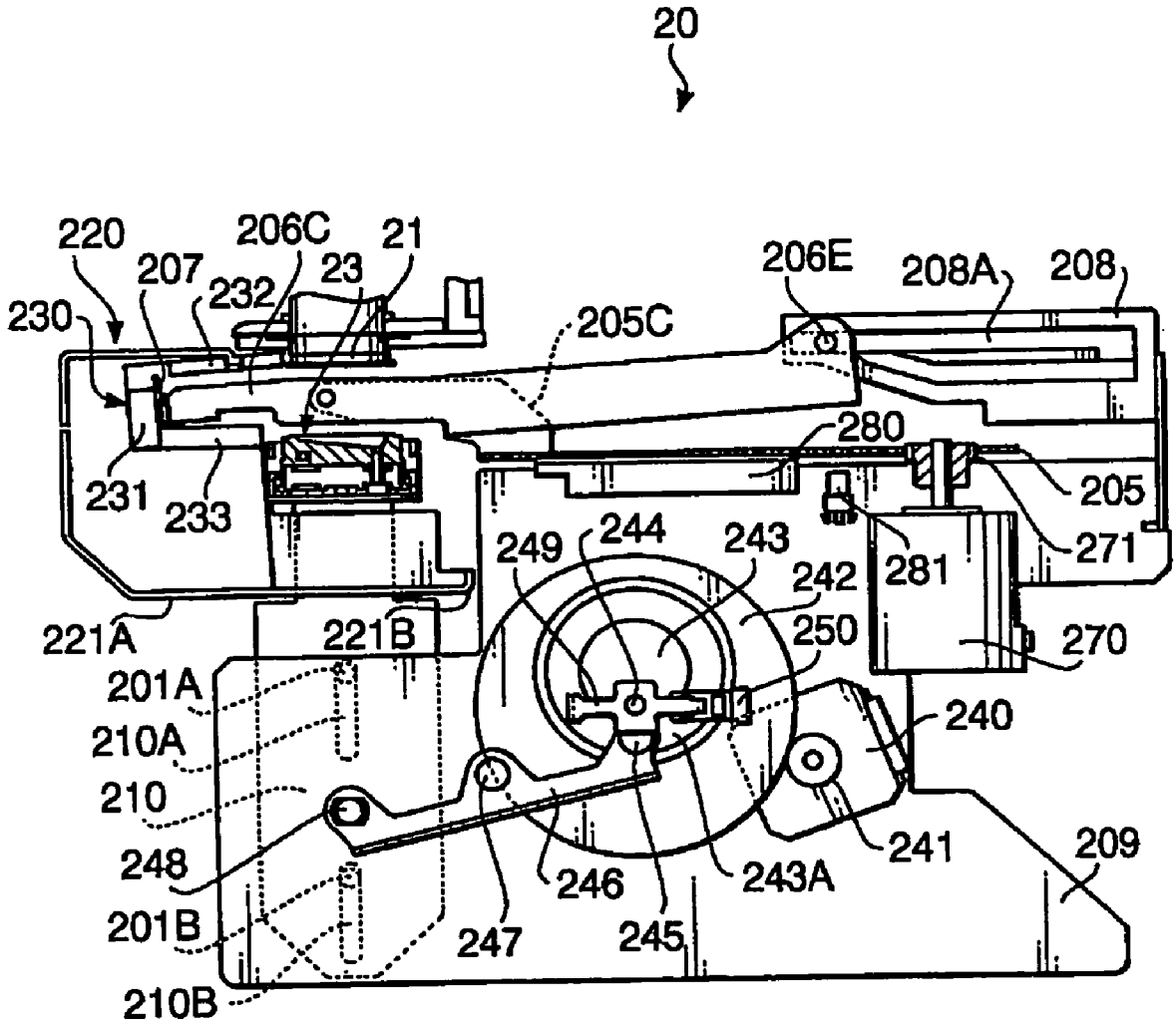
FIG. 13 is a cross-sectional view of the purge unit viewed along the lateral direction.
Figure 14:
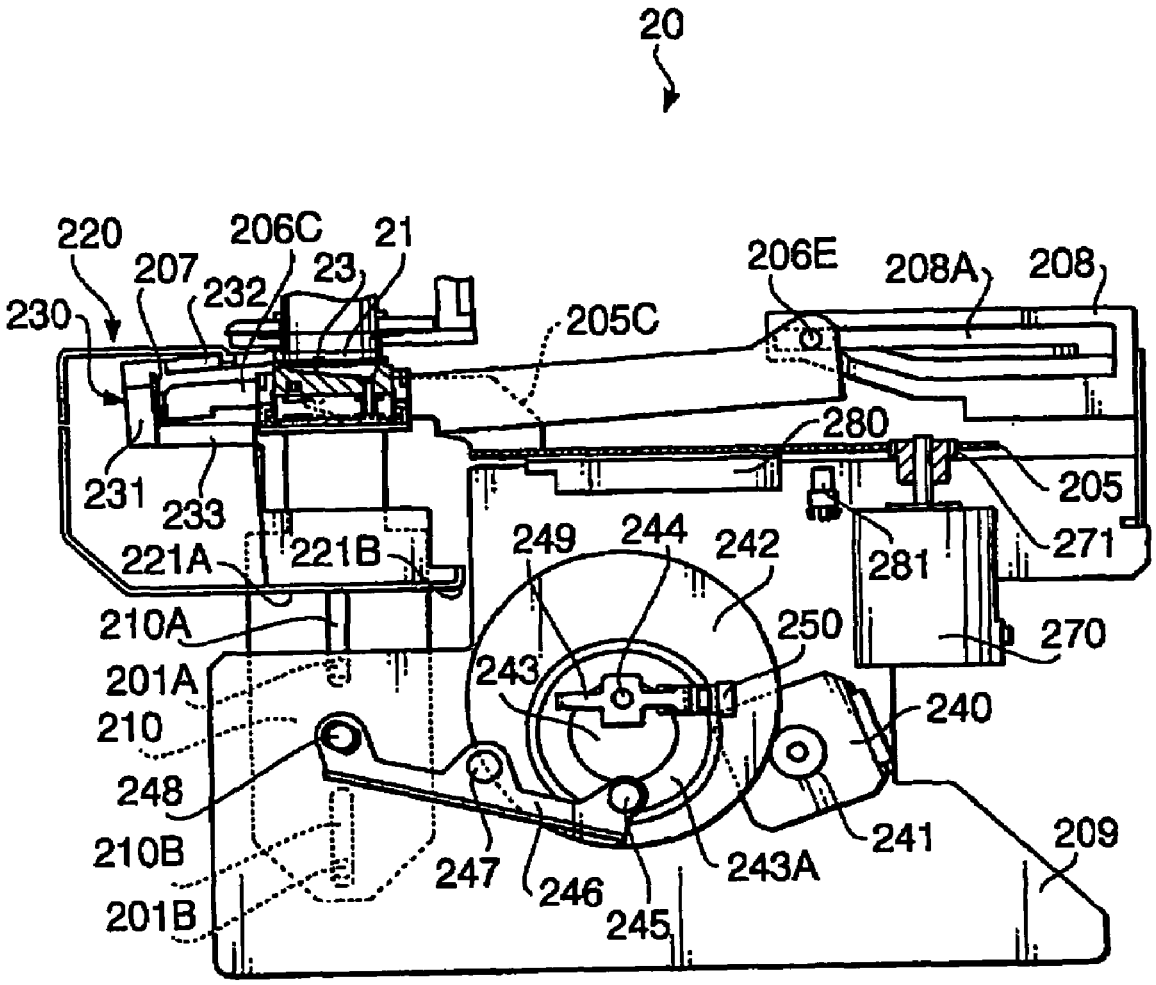
FIG. 14 is a cross-sectional view of the purge unit viewed along the lateral direction.

FIG. 10 is a front view of a position sensing arm 249 and a photo interrupter 250. FIG. 11 is a plan view of the position sensing arm 249 and the photo interrupter 250. FIGS. 12 to 14 are cross-sectional views of the purge unit 20 viewed along the lateral direction.

The position sensing arm 249 and the photo interrupter 250 are used to detect the upper end point and the lower end point of a moving range of the suction cap 23. The position sensing arm 249 is fixed to the shaft 244 to be rotatable about the shaft 244 (see a double-headed arrow in FIG. 10) with the rotation of the large gear 242. The photo interrupter 250 is fixed to the purge unit frame by fixing members (not shown).

As shown in FIGS. 10 and 11, the position sensing arm 249 has bended end portions 249A and 249B, and is configured such that each of the bended end portions 249A and 249B passes through a space between a light source 250A and a photoreceptor 250B of the photo interrupter 250 when the position sensing arm 249 rotates about the shaft 244. The end portion 249A has a width larger than that of the end portion 249B.

As shown in FIG. 12, the end portion 249B having a narrower width than the end portion 249A passes through the space between the light source 250A and the photoreceptor 250B when the suction cap 230 is situated at the lower end point. As shown in FIG. 14, the end portion 249A having a larger width than the end portion 249B passes through the space between the light source 250A and the photoreceptor 250B when the suction cap 230 is situated at the upper end point.

Therefore, by detecting the length of time that the space between the light source 250A and the photoreceptor 250B is blocked, it becomes possible to determine whether the suction cap 230 is situated at the upper end point or the lower end point. That is, it is determined that the suction cap 230 is situated at the upper end point if the length of time that the space between the light source 250A and the photoreceptor 250B is blocked is longer than a predetermined time, and it is determined that the suction cap 230 is situated at the lower end point if the length of time that the space between the light source 250A and the photoreceptor 250B is blocked is shorter than the predetermined time.

As shown in FIGS. 3, 12 to 14, a photo interrupter 281 is fixed to the purge unit 20 under the base plate 205. In addition, the base plate 205 is provided with a blocking plate 280 having a rectangular shape on the lower surface thereof. The blocking plate 280 is formed to be elongated in parallel with the moving direction of the wiper blade 207.

More specifically, the blocking plate 280 is formed such that when the wiper blade 207 and the wiper blade arms 206C and 206D are situated at positions at which the wiper blade 207 and the wiper blade arms 206C and 206D interfere with the moving range of the suction cap 230, the blocking plate 280 blocks a space between a light source and a photoreceptor of the photo interrupter 281. As shown in FIGS. 3 and 13, when the wiper blade 207 is situated at positions at which the wiper blade 207 does not interfere with the moving range of the suction cap 23, the blocking plate 280 does not block the space between the light source and the photoreceptor of the photo interrupter 281. As shown in FIG. 12, when the wiper blade 207 is situated at positions at which the wiper blade 207 interferes with the moving range of the suction cap 23, the blocking plate 280 blocks the space between the light source and the photoreceptor of the photo interrupter 281.

Although the present invention has been described in considerable detail with reference to certain preferred embodiments thereof, other embodiments are possible.

In the above mentioned embodiment, the inkjet printing device is configured to have four inkjet heads; however, the number of inkjet heads is not limited to such a number. For example, five, six or seven inkjet heads may be employed in the inkjet head printing device 1.

It is understood that the present invention can be also applied to various type of printing devices, such as a typical inkjet printer that prints images on a sheet, although the above mentioned embodiment particularly described the inkjet printing device for fabric.

In the above mentioned embodiment, a photo interrupter is used to detect positions of the wiper blade 207 and the suction cap 23, another detecting device, e.g., a microswicth (limit switch), may be alternatively used to detect positions of the wiper blade 207 and the suction cap 23.

It is understood from the above mentioned embodiment that drawbacks that conventional inkjet printing devices have are resolved by the printing device 1 according to the embodiment. One of such drawbacks of the conventional inkjet printer is that a wiper blade and an absorbing material are integrally held by a holder (as indicated, for example, in the publication HEI 9-48134) and thereby a maintenance worker soils his/her hands with ink during replacement work of the wiper blade. This drawback is resolved by the configuration of the configuration of the cleaning cassette 230 and the cassette holder 220 as described above.

Another drawback of the conventional inkjet printing device is that ink is splashed at the instant at which a wiper blade is detached from a nozzle surface and thereby janitorial work is required to be conducted at regular time intervals. Such janitorial work is very troublesome and a worker may soil his/her hands with ink. Further, there is a possibility that recording media are soiled by ink splashes. This drawback is resolved by the configuration of the cleaning cassette 230 (particularly by the second absorbent member 232) as described above.

Another drawback of the conventional inkjet printing device is that ink drops from an ink absorbing member configured to contact a wiper blade to absorb ink from the wiper blade, and thereby the inkjet printing device is soiled by dropped ink. This drawback is resolved by the configuration of the cassette holder 220 (particularly by the bottom wall 221A) as described above.

What is claimed is:

1. An inkjet printing device, comprising:

an inkjet head that ejects ink onto a substrate; and an ejection restoring system configured to restore ejection performance of the inkjet head, the ejection restoring system including:

a wiping member used to wipe residual ink off a nozzle surface of the inkjet head;

a wiper driving system that moves the wiping member relative to the nozzle surface; and a wiper maintenance unit that removes ink adhered to the wiping member, the wiper maintenance unit including:

a cassette having an absorbent member therein, the absorbent member absorbing ink adhered to the wiping member; and a cassette holder to which the cassette is detachably attached, wherein:

the cassette has an upper wall, a bottom wall and a side wall;

the cassette has an opening through which the wiping member enters the cassette; and the absorbent member is placed in the inside of the cassette.

2. The inkjet printing device according to claim 1, wherein the wiper maintenance unit is located at a predetermined position along a moving path of the wiping member to remove ink adhered to the wiping member.

3. The inkjet printing device according to claim 2, further comprising a sucking device configured to closely contact the nozzle surface to suck the ink from the nozzle surface.

4. The inkjet printing device according to claim 3, wherein the cassette holder has an ink catching part that catches ink dropping from at least one of the inkjet head, the wiping member and the sucking device.

5. The inkjet printing device according to claim 4, wherein the ink catching portion is elongated under a moving range of the wiping member so as to catch the ink dropping from the wiping member.

6. The inkjet printing device according to claim 2, wherein the wiper maintenance unit is configured such that the cassette holder is detachably attached to the wiper maintenance unit.

7. The inkjet printing device according to claim 2, wherein the wiping member has an edge portion that contacts the nozzle surface to wipe the residual ink off the nozzle surface, wherein the absorbent member is located, at an end position of a moving path of the wiping member, on a downstream side of the nozzle surface, wherein the absorbent member contacts the wiping member so as to absorb ink adhered to the wiping member when the wiping member is situated at the end position, and wherein the edge portion of the wiping member does not contact the absorbent member when the wiping member is situated at the end position.

8. An inkjet printing device, comprising:

an inkjet head that ejects ink onto a substrate; and an ejection restoring system configured to restore ejection performance of the inkjet head, the ejection restoring system including:

a wiping member used to wipe residual ink off a nozzle surface of the inkjet head;

a wiper driving system that moves the wiping member relative to the nozzle surface; and a wiper maintenance unit that removes ink adhered to the wiping member, the wiper maintenance unit including:

a cassette having an absorbent member therein, the absorbent member absorbing ink adhered to the wiping member;

a cassette holder to which the cassette is detachably attached; and a sucking device configured to closely contact the nozzle surface to suck the ink from the nozzle surface, wherein the wiper maintenance unit is located at a predetermined position along a moving path of the wiping member to remove ink adhered to the wiping member, wherein the cassette holder has an ink catching part that catches ink dropping from at least one of the inkjet head, the wiping member and the sucking device, wherein the ink catching portion is elongated under a moving range of the wiping member so as to catch the ink dropping from the wiping member, and wherein the ink catching portion is elongated to catch the ink dropping from all of the inkjet head, the wiping member and the sucking device.

9. An inkjet printing device, comprising:

an inkjet head that ejects ink onto a substrate; and an ejection restoring system configured to restore ejection performance of the inkjet head, the ejection restoring system including:

a wiping member used to wipe residual ink off a nozzle surface of the inkjet head;

a wiper driving system that moves the wiping member relative to the nozzle surface; and a wiper maintenance unit that removes ink adhered to the wiping member, the wiper maintenance unit including:

a cassette having an absorbent member therein, the absorbent member absorbing ink adhered to the wiping member; and a cassette holder to which the cassette is detachably attached, wherein the wiper maintenance unit is located at a predetermined position along a moving path of the wiping member to remove ink adhered to the wiping member; and wherein the cassette holder includes an upper housing and a lower housing, the upper housing being attached to the lower housing so as to be openable and closable with respect to the lower housing.

10. The inkjet printing device according to claim 9, wherein the cassette is detachably attached to the upper housing of the cassette holder, the cassette being held between the upper housing and the lower housing when the upper housing is in a closed state.

11. The inkjet printing device according to claim 10, wherein the upper housing has a hooking nail, and wherein the cassette has an engagement hole to which the hooking nail of the upper housing is fixedly hooked.

12. An inkjet printing device, comprising:

an inkjet head that ejects ink onto a substrate; and an ejection restoring system configured to restore ejection performance of the inkjet head, the ejection restoring system including:

a wiping member having an edge portion that contacts a nozzle surface of the inkjet head to wipe residual ink off the nozzle surface;

a wiper driving system that moves the wiping member relative to the nozzle surface; and a wiper maintenance unit that removes ink adhered to the wiping member, the wiper maintenance unit including a first absorbent member that is located, at an end position of a moving path of the wiping member, on a downstream side of the nozzle surface, the first absorbent member contacting the wiping member so as to absorb ink adhered to the wiping member when the wiping member is situated at the end position, the edge portion of the wiping member not contacting the first absorbent member when the wiping member is situated at the end position.

13. The inkjet printing device according to claim 12, wherein the wiper maintenance unit is located at a predetermined position along the moving path of the wiping member to remove ink adhered to the wiping member.

14. The inkjet printing device according to claim 13, wherein the first absorbent member has a contacting surface that contacts a base portion of the wiping member when the wiping member is situated at the end position.

15. The inkjet printing device according to claim 14, wherein the wiper maintenance unit further includes a second absorbent member located on the downstream side of the nozzle surface along the moving path of the wiping member, and wherein the second absorbent member contacts the edge portion of the wiping member to absorb ink adhered to the wiping member when the wiping member moves along the moving path.

16. The inkjet printing device according to claim 15, wherein the second absorbent member is located such that the edge portion of the wiping member does not contact the second absorbent member when the wiping member is situated at the end position.

17. An inkjet printing device, comprising:

an inkjet head that ejects ink onto a substrate; and an ejection restoring system configured to restore ejection performance of the inkjet head, the ejection restoring system including:

a wiping member having an edge portion that contacts a nozzle surface of the inkjet head to wipe residual ink off the nozzle surface;

a wiper driving system that moves the wiping member relative to the nozzle surface; and a wiper maintenance unit that removes ink adhered to the wiping member, the wiper maintenance unit including a first absorbent member that is located, at an end position of a moving path of the wiping member, on a downstream side of the nozzle surface, the first absorbent member contacting the wiping member so as to absorb ink adhered to the wiping member when the wiping member is situated at the end position, the edge portion of the wiping member not contacting the first absorbent member when the wiping member is situated at the end position, wherein the wiper maintenance unit is located at a predetermined position along the moving path of the wiping member to remove ink adhered to the wiping member, wherein the first absorbent member has a contacting surface that contacts a base portion of the wiping member when the wiping member is situated at the end position, wherein the wiper maintenance unit further includes a second absorbent member located on the downstream side of the nozzle surface along the moving path of the wiping member, wherein the second absorbent member contacts the edge portion of the wiping member to absorb ink adhered to the wiping member when the wiping member moves along the moving path, wherein the wiper maintenance unit further includes a third absorbent member located on an opposite side of the second absorbent member with respect to the moving path of the wiping member, and wherein the third absorbent member lies under the second absorbent member so as to absorb ink dropping thereon.

18. The inkjet printing device according to claim 17, wherein the third absorbent member is located adjacently to the first absorbent member.

19. The inkjet printing device according to claim 17, wherein the wiper maintenance unit includes:

a cassette in which the first, second and third absorbent members are accommodated; and a cassette holder to which the cassette is detachably attached.

20. A wiper maintenance unit for removing ink adhered to a wiping member, comprising:

a cassette having an absorbent member therein, the absorbent member absorbing ink adhered to the wiping member when the wiping member contacts the absorbent member; and a cassette holder to which the cassette is detachably attached, wherein:

the cassette has an upper wall, a bottom wall and a side wall;

the cassette has an opening through which the wiping member enters the cassette; and the absorbent member is placed in the inside of the cassette.

21. A wiper maintenance unit for removing ink adhered to a wiping member, comprising:

a cassette; and a first absorbent member fixed to an inner surface of the cassette, the first absorbent member being located, at an end position of a moving path of the wiping member, on a downstream side of a nozzle surface to contact the wiping member situated at the end position, the first absorbent member absorbing ink adhered to the wiping member when the wiping member is situated at the end position, the first absorbent member being configured such that an edge portion of the wiping member does not contact the first absorbent member when the wiping member is situated at the end position.

22. An inkjet printing device, comprising:

an inkjet head that ejects ink onto a substrate; and an ejection restoring system configured to restore ejection performance of the inkjet head, the ejection restoring system including:

a wiping member used to wipe residual ink off a nozzle surface of the ink jet head;

a wiper driving system that moves the wiping member relative to the nozzle surface; and a wiper maintenance unit that removes ink adhered to the wiping member, the wiper maintenance unit including:

a cassette having an absorbent member therein, the absorbent member absorbing ink adhered to the wiping member; and a cassette holder to which the cassette is detachably attached, the cassette holder having a housing element that rotates for the cassette holder to switch between an open state and a closed state.

23. A wiper maintenance unit for removing ink adhered to a wiping member, comprising:

a cassette having an absorbent member therein, the absorbent member absorbing ink adhered to the wiping member when the wiping member contacts the absorbent member; and a cassette holder to which the cassette is detachably attached, the cassette holder having a housing element that rotates for the cassette holder to switch between an open state and a closed state.

* * * * *